US008995882B2

(12) United States Patent
Miura

(10) Patent No.: US 8,995,882 B2
(45) Date of Patent: Mar. 31, 2015

(54) IMAGE FORMING APPARATUS WITH FIRST AND SECOND PRINT ENGINES

(71) Applicant: Oki Data Corporation, Tokyo (JP)

(72) Inventor: Hiroshi Miura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 125 days.

(21) Appl. No.: 13/845,048

(22) Filed: Mar. 17, 2013

(65) Prior Publication Data

US 2013/0251411 A1 Sep. 26, 2013

(30) Foreign Application Priority Data

Mar. 23, 2012 (JP) ..... 2012-067184

(51) Int. Cl.
*G03G 15/01* (2006.01)
*G03G 15/16* (2006.01)
*G03G 15/00* (2006.01)

(52) U.S. Cl.
CPC ..... *G03G 15/16* (2013.01); *G03G 15/6585* (2013.01); *G03G 15/0189* (2013.01)
USPC ..... 399/223; 399/298; 399/299

(58) Field of Classification Search
CPC ..... G03G 15/0178; G03G 15/0189; G03G 15/0194
USPC ..... 399/223, 298, 299, 302, 303, 341
See application file for complete search history.

(56) References Cited

U.S. PATENT DOCUMENTS

| | | | | |
|---|---|---|---|---|
| 5,122,843 | A * | 6/1992 | Yokoyama et al. | 399/231 |
| 5,963,763 | A * | 10/1999 | Kabai et al. | 399/223 |
| 8,268,522 | B2 * | 9/2012 | Kadokura et al. | 430/107.1 |
| 8,298,737 | B2 * | 10/2012 | Kadokura et al. | 430/108.1 |

FOREIGN PATENT DOCUMENTS

| | | |
|---|---|---|
| JP | 1-267569 | 10/1989 |
| JP | 08-137183 | 5/1996 |
| JP | 11-237800 | 8/1999 |
| JP | 2003-295622 | 10/2003 |
| JP | 2004-151260 | 5/2004 |
| JP | 2010-533318 | 10/2010 |
| JP | 2011-039378 A | 2/2011 |
| JP | 2011-107534 | 6/2011 |

* cited by examiner

*Primary Examiner* — William J Royer
(74) *Attorney, Agent, or Firm* — Rabin & Berdo, P.C.

(57) ABSTRACT

An image forming apparatus includes a first print engine and a second print engine. The first print engine forms a first image formed of a first toner having a first average diameter. The first image is transferred onto a recording medium. The second print engine forms a second image formed of a second toner having a second average diameter larger than the first average diameter. The second image is transferred onto the first image in registration.

23 Claims, 9 Drawing Sheets

FIG. 5

| EXAMPLE No. | AVERAGE PARTICLE DIAMETER OF WHITE TONER (μm) | CHANGE IN SHADE OF COLOR |
|---|---|---|
| 1 | 11.2 | × × |
| 2 | 8.9 | × |
| 3 | 6.9 | × |
| 4 | 6.7 | △ |
| 5 | 6.5 | ○ |
| 6 | 6.3 | ○ |
| 7 | 6.1 | ◎ |
| 8 | 6.0 | ◎ |

CYAN TONER HAS AN AVERAGE PARTICLE DIAMETER OF 7.0μm

FIG. 6

| EXAMPLE No. | AVERAGE PARTICLE DIAMETER OF WHITE TONER (μm) | CHANGE IN SHADE OF COLOR |
|---|---|---|
| 1 | 11.2 | × × |
| 2 | 8.9 | × |
| 3 | 6.9 | × |
| 4 | 6.7 | × |
| 5 | 6.5 | △ |
| 6 | 6.3 | ○ |
| 7 | 6.1 | ◎ |
| 8 | 6.0 | ◎ |

CYAN TONER HAS AN AVERAGE PARTICLE DIAMETER OF 6.8μm

IMAGE FORMING APPARATUS WITH FIRST AND SECOND PRINT ENGINES

BACKGROUND OF THE INVENTION

1. Field of the Invention

The present invention relates to an electrophotographic image forming apparatus that forms an image on a recording medium.

2. Description of the Related Art

A color electrophotographic printer is known which includes a plurality of image forming units, each unit including a photoconductive drum, a charging unit, an exposing unit, and a developing unit. One such apparatus is a tandem color printer disclosed in Japanese Patent Application No. 2011-39378. Black (K), yellow (Y), magenta (M), and cyan (C) image forming units are aligned along the transport path of a print medium. As the print medium passes through the image forming units in sequence, toner images of corresponding colors are transferred onto an intermediate transfer belt in registration. The toner images are then transferred onto print paper fed in timed relation with the formation of the respective toner images.

When a color image is formed on a recording medium having a color other than white, a white toner may be used to hide the color of the recording medium. However, a color toner transferred onto the white toner can be mixed with the white toner, impairing a desired image quality.

SUMMARY OF THE INVENTION

An object of the present invention is to provide an image forming apparatus capable of offering a quality image.

An image forming apparatus includes a first print engine and a second print engine. The first print engine forms a first image formed of a first toner having a first average diameter. The first image is transferred onto a recording medium. The second print engine forms a second image formed of a second toner having a second average diameter larger than the first average diameter. The second image is transferred onto the first image in registration.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 5 is a table that lists the experimental results, illustrating the relationship between the average particle diameter of the white toner and the changes in shade of color due to the mixture of the white toner and cyan toner;

FIG. 6 lists experimental changes in the shade of color when the cyan toner having an average particle diameter of 6.8 μm is mixed with the white toners having different average particle diameters;

DETAILED DESCRIPTION OF THE INVENTION

The present invention will be described in detail by way of preferred embodiments with reference to the accompanying drawings.

First Embodiment

Configuration of Image Forming Apparatus

Figure 1:
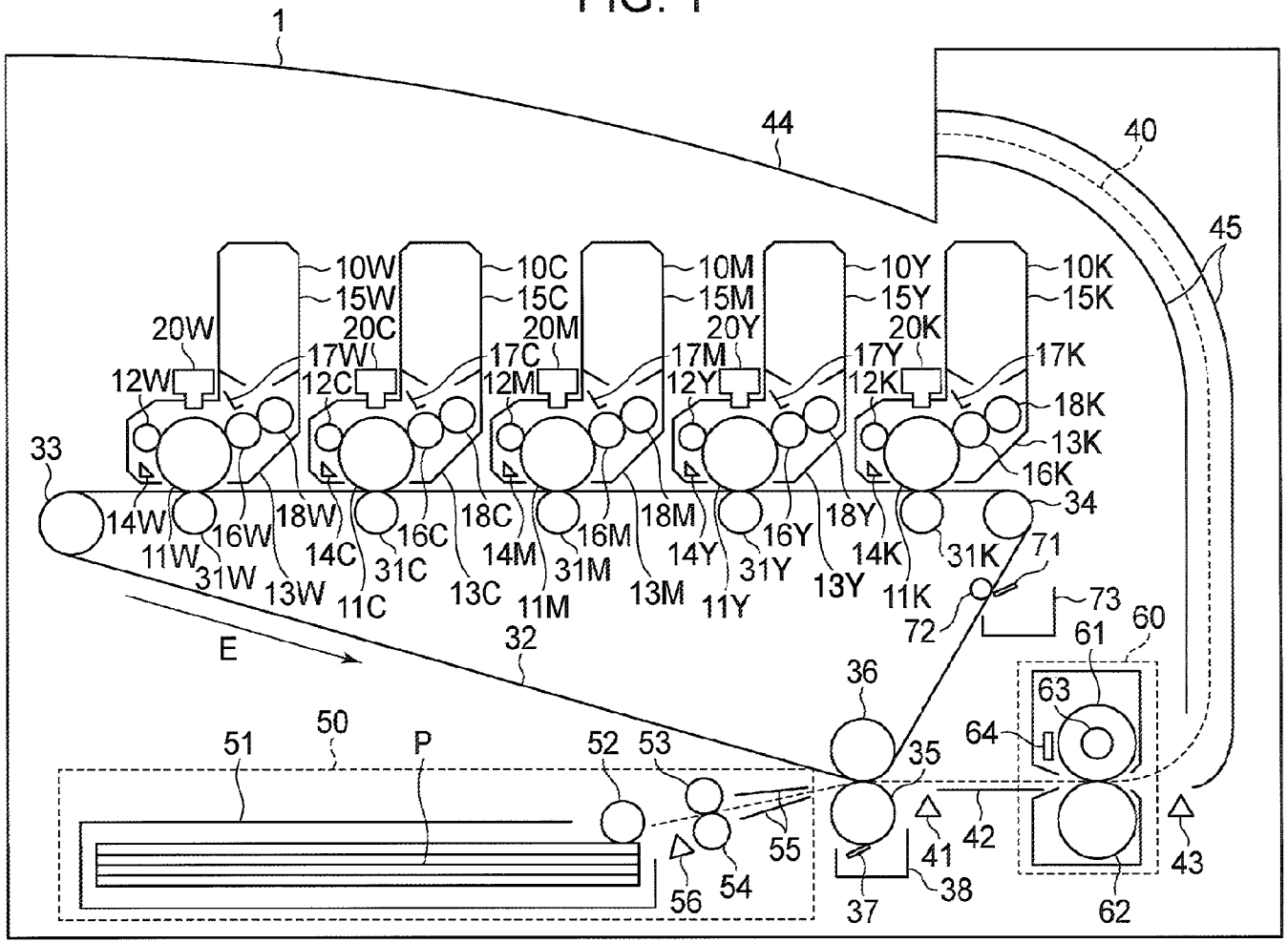
FIG. 1 is a schematic diagram illustrating an image forming apparatus according to a first embodiment.
Figure 2:
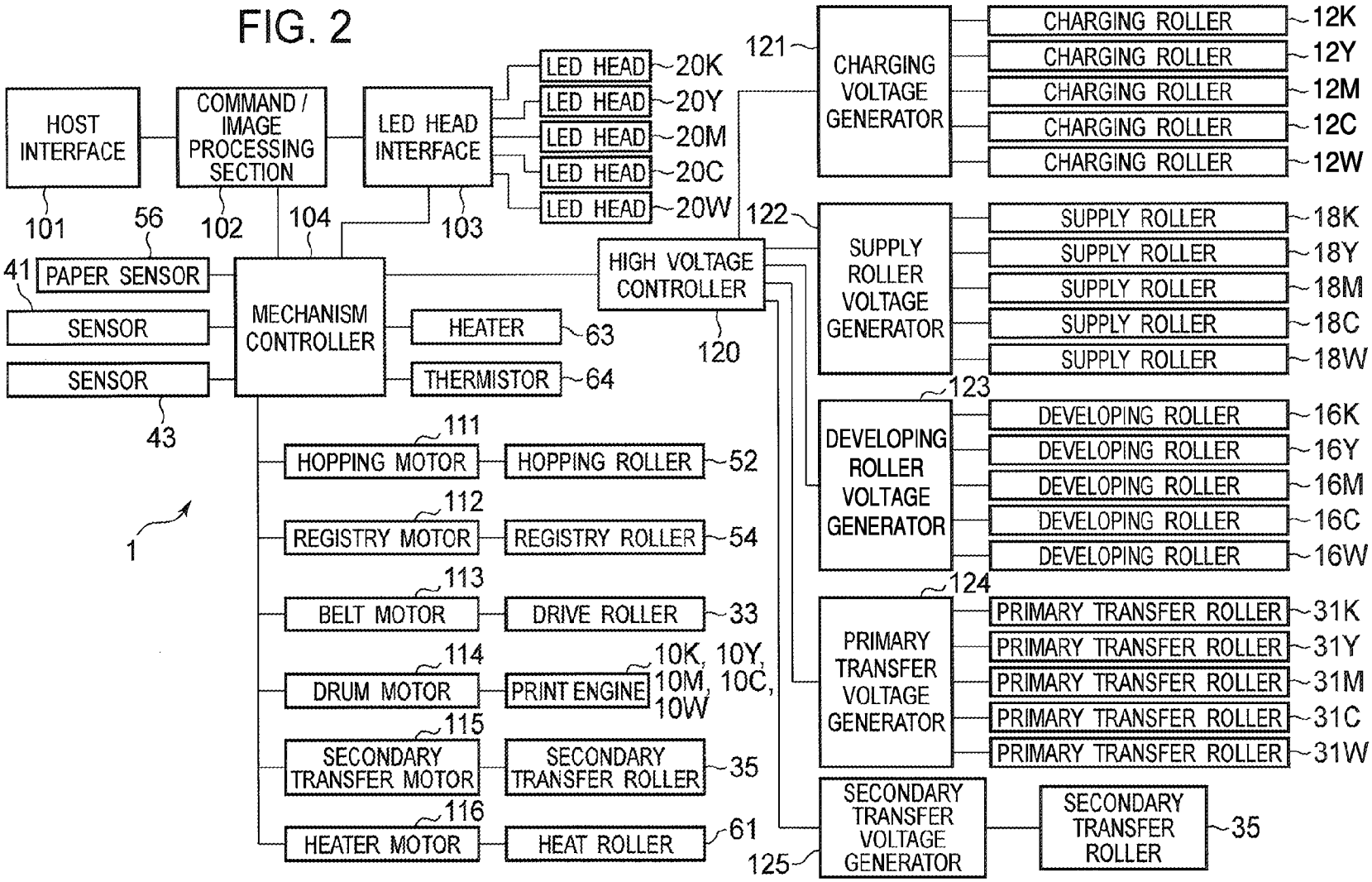
FIG. 2 is a block diagram illustrating the respective functions of the image forming apparatus.

FIG. 1 is a schematic diagram illustrating an image forming apparatus 1 according to a first embodiment. FIG. 2 is a block diagram illustrating the respective functions of the image forming apparatus 1. The image forming apparatus 1 forms images by electrophotography, and takes the form of a printer that prints an image on a recording medium or print paper P in accordance with print data received from an external apparatus. The print data includes that of a white image as a background.

Referring to FIG. 1, the image forming apparatus 1 includes five independent process units, which print black (K), yellow (Y), magenta (M), cyan (C), and white (W) images, respectively. The process units include print engines 10K, 10Y, 10M, 10C, and 10W, respectively. The print engines 10K, 10Y, 10M, 10C, and 10W are aligned along an intermediate transfer belt 32.

The black print engine 10K includes a photoconductive drum 11K as an image bearing body, a charging roller 12K, an exposing unit 20K, a developing unit 13K, a neutralizing light source 14K as a neutralizer, and a toner cartridge 15K that holds a black toner therein. The photoconductive drum 11K bears an electrostatic latent image formed thereon. The charging roller 12K charges the surface of the photoconductive drum 11K. The exposing unit 20K, illuminates the charged surface of the photoconductive drum 11K to form an electrostatic latent image. The developing unit 13K supplies the black toner to the electrostatic latent image to develop the electrostatic latent image, formed on the surface of the photoconductive drum 11K, with the black toner into a black toner image. The developing unit 13K includes a developing roller 16K, a developing blade 17K, and a supply-roller 18K. The developing roller 16K supplies the black toner to the electrostatic latent image on the photoconductive drum 11K. The developing blade 17K forms a thin layer of the black toner on the developing roller 16K. The supply roller 18K supplies the black toner to the developing roller 16K. The neutralizing light source 14K illuminates the surface of the photoconductive drum 11K after transferring the toner image onto the print paper P. The toner cartridge 15K holds the black toner therein, and supplies the black toner into the developing unit 13K.

An LED head 20K as the exposing unit is disposed above the photoconductive drum 11K and parallels the photoconductive drum 11K. The LED head 20K illuminates the charged surface of the photoconductive drum 11K to form an electrostatic latent image in accordance with the print data. The LED head 20K includes a printed circuit board on which LED arrays, driver ICs that drive the LED arrays, a shift register that holds image data, and a SELFOC lens array that focuses the light from the LED arrays on the charged surface of the photoconductive drum 11K.

Likewise, the print engines 10Y, 10M, 10C, and 10W include photoconductive drums 11Y, 11M, 11C, and 11W, charging rollers 12Y, 12M, 12C, and 12W, developing units 13Y, 13M, 13C, and 13W, neutralizing light sources 14Y, 14M, 14C, and 14W, toner cartridges 15Y, 15M, 15C, and 15W, respectively. The developing units 13Y, 13M, 13C, and 13W include developing rollers 16Y, 16M, 16C, and 16W, developing blades 17Y, 17M, 17C, and 17W, and supply-rollers 18Y, 18M, 18C, and 18W, respectively. LED heads 20Y, 20, 20C, and 20W are disposed over the print engines 10Y, 10M, 10C, and 10W, respectively. The LED heads 20Y, 20M, 20C, and 20W receive yellow, magenta, cyan, and white image signals, respectively, and illuminate the photoconductive drums 11Y, 11M, 11C, and 11W in accordance with the yellow, magenta, cyan, and white image signals, respectively, thereby forming electrostatic latent images of the respective colors. The term "color" refers to a chromatic color other than black and white.

The respective color toners contain polyester resin, internal additives, and an external additive. Polyester resin serves as a binder resin. The internal additives are a charge control agent, a toner release agent, and a colorant. The external additive is, for example, silica. The toners according to the embodiment are pulverized toners. Instead, the toners may be polymerized toners.

Primary transfer rollers 31K, 31Y, 31M, 31C, and 31W are disposed under the print engines 10K, 10Y, 10M, 10C, and 10W, and parallel the photoconductive drums 11K, 11Y, 11M, 11C, and 11W, respectively, so that the intermediate transfer belt 32 is sandwiched between the photoconductive drums 11K, 11Y, 11M, 11C, and 11W and the corresponding primary transfer rollers 31K, 31Y, 31M, 31C, and 31W. The intermediate transfer belt 32 takes the form of an endless belt formed of, for example, a semiconductive plastic film having a smooth, flat surface, and serves as an image bearing body on which the toner images are carried. The intermediate transfer belt 32 is disposed about a drive roller 33, a driven roller 34, and a tension roller 36 under a predetermined tension. A belt motor 113 (FIG. 2) drives the drive roller 33 in rotation, so that the intermediate transfer belt 32 runs in a direction shown by arrow E. The upper half of the intermediate transfer belt 32 is sandwiched between the photoconductive drums 11K, 11Y, 11M, 11C, and 11W and the corresponding primary transfer rollers 31K, 31Y, 31M, 31C, and 31W. The primary transfer rollers 31K, 31Y, 31M, 31C, and 31W receive a dc voltage from a primary transfer voltage generator 124 (FIG. 2), thereby transferring the toner images formed on the photoconductive drums 11K, 11Y, 11M, 11C, and 11W onto the intermediate transfer belt 32.

A paper feeding mechanism 50 is disposed at a lower portion of the image forming apparatus 1, and feeds the paper P into a transport path 40 (enclosed by dotted lines in FIG. 1). The paper feeding mechanism 50 includes a paper cassette 51, a registry roller 52, a pinch roller 53, a hopping roller 54, a guide 55, and a paper sensor 56. The hopping roller 52 advances the paper P from the paper cassette 51. The pinch roller 53 cooperates with the registry roller 54 to correct the skew of the paper P. The registry roller 54 receives the paper P from the hopping roller 52, and then feeds the paper P to a contact area between the tension roller 36 and a secondary transfer roller 35. The guide 55 guides the paper P to the tension roller 36. The paper sensor 56 senses the paper P when the paper P arrives at the nip area formed between the pinch roller 53 and the registry roller 54.

The secondary transfer roller 35 is located downstream of the paper feeding mechanism 50. The secondary transfer roller 35 faces the tension roller 36 so that the intermediate transfer belt 32 is sandwiched between the tension roller 36 and the secondary transfer roller 35. The tension roller 36 pushes the intermediate transfer belt 32 against the secondary transfer roller 35, thereby defining a secondary transfer point between the intermediate transfer belt 32 and the secondary transfer roller 35. When the secondary transfer roller 35 is driven in rotation by a secondary transfer motor 115 (FIG. 2), the tension roller 36 is driven in rotation due to the friction between the tension roller 36 and the intermediate transfer belt 32. The secondary transfer roller 35 receives a predetermined dc voltage from the secondary transfer voltage generator 125 (FIG. 2), thereby transferring the toner image on the intermediate transfer belt 32 onto the paper P. A cleaning blade 37 is formed of a flexible rubber material or a plastic material so that the cleaning blade 37 scrapes the residual toner from the secondary transfer roller 35 into a waste toner tank 38.

A sensor 41, a guide 42, and a fixing mechanism 60 are located downstream of the secondary transfer roller 35. The sensor 41 watches for wrapping of the paper P around the secondary transfer roller 35 and failure of the paper P to leave the intermediate transfer belt 32. The guide 42 guides the paper P passing through the secondary transfer point, defined between the intermediate transfer belt 32 and the secondary transfer roller 35, to the fixing mechanism 60.

The fixing mechanism 60 includes a heat roller 61 and a pressure roller 62 that presses the heat roller 61, and fixes the toner image on the paper P. The heat roller 61 is driven in rotation by a heater motor 116 (FIG. 2) while the pressure roller 62 follows the heat roller 61 due to the friction between the heat roller 61 and the pressure roller 62. The heat roller 61 incorporates a heater 63 in the form of a halogen lamp. A thermistor 64 is disposed in the vicinity of the heat roller 61, and monitors the surface temperature of the heat roller 61.

A sensor 43 is disposed downstream of the fixing mechanism 60 with respect to the paper transport path. The sensor 43 watches for paper jam and wrapping of the paper P around the heat roller 61. Guides 45 are disposed downstream of the sensor 43 and guide the paper P to a stacker 44 located at the upper portion of the image forming apparatus 1, the printed paper P being discharged onto the stacker 44.

A cleaning blade 71 contacts the surface of the intermediate transfer belt 32, and removes the toner that failed to be transferred and remains on the intermediate transfer belt 32. The cleaning blade 71 is disposed so that the intermediate transfer belt 32 is sandwiched between the cleaning blade 71 and a roller 72. The cleaning blade 71 is formed of a flexible rubber material or a plastic material, and scrapes the residual toner off the intermediate transfer belt 32 into a waste toner tank 73.

The configuration of the control circuit of the image forming apparatus 1 according to the first embodiment will be described. Referring to FIG. 2, the image forming apparatus 1 includes a host interface 101, a command/image processing section 102, an LED head interface 103, a mechanism controller 104, and a high voltage controller 120.

The host interface 101 performs a physical hierarchical interface with a host computer (not shown), and includes a connector and a communication chip.

The command/image processing section 102 parses the commands received from the host computer, and interprets the image data, i.e., renders the image data into bit map data. The command/image processing section 102 includes a microprocessor, a random access memory (RAM) and hardware specially designed for rendering the image data into the bit map data, and performs the overall control of the image forming apparatus 1.

The LED head interface 103 includes a semi customized large scale integrated circuit (LSI) and a RAM, and processes the bit map data received from the command/image processing section 102 so that the LED heads 20K, 20Y, 20M, 20C, and 20W can work with the bit map data.

The mechanism controller 104 performs the control of the respective portions of the print engines 10K, 10Y, 10M, 10C and 10W of the image forming apparatus 1. In accordance with the commands from the command/image processing section 102 and the outputs of the paper sensor 56, sensor 41, and sensor 43, the mechanism controller 104 controls a hopping motor 111, registry motor 112, belt motor 113, drum motor 114, secondary transfer motor 115, heater motor 116, heater 63, and high voltage controller 120, thereby controlling the mechanism of the print engines and the high voltage power supply.

The hopping motor 111, registry motor 112, belt motor 113, and secondary transfer motor 115 drive the hopping roller 52, registry roller 54, drive roller 33, and secondary transfer roller 35 in rotation. The drum motor 114 drives the print engines 10K, 10Y, 10M, 10C, and 10W to operate. The heater motor 116 drives the heat roller 61. Each motor is driven by a corresponding driver. The heater 63 incorporates a halogen lamp therein. The thermistor 64 is disposed in the vicinity of the surface of the heat roller 61. The mechanism controller 104 performs the temperature control of the heat roller 61 in accordance with the output of the thermistor 64.

The high voltage controller 120 is in the form of a microprocessor or customized LSI, and controls a charging voltage generator 121, a supply roller voltage generator 122, a developing roller voltage generator 123, the primary transfer voltage generator 124, and the secondary transfer voltage generator 125.

The charging voltage generator 121 generates or does not generate the charging voltages that should be supplied to the charging rollers 12K, 12Y, 12M, 12C and 12W in accordance with the command from the high voltage controller 120.

In response to the command received from the high voltage controller 120, the supply roller voltage generator 122 generates the supply roller voltage that should be supplied to the supply-rollers 18K, 18Y, 18M, 18C, and 18W.

In response to the command received from the high voltage controller 120, the developing roller voltage generator 123 generates the developing voltages that should be supplied to the developing rollers 16K, 16Y, 16M, 16C, and 16W, respectively.

In response to the command received from the high voltage controller 120, the primary transfer voltage generator 124 generates primary transfer voltages that should be supplied to the primary transfer rollers 31K, 31Y, 31M, 31C, and 31W, respectively.

In response to the command received from the high voltage controller 120, the secondary transfer voltage generator 125 generates the secondary transfer voltage that should be supplied to the secondary transfer roller 35.

{Operation of Image Forming Apparatus}

A description will be given of the operation of the image forming apparatus 1. Upon reception of the image data from the host computer via the host interface 101, the command/image processing section 102 commands to initiate warming up of the fixing mechanism 60 of the mechanism controller 104, and renders the image data into the bit map data on a page-by-page basis for each color. Upon reception of a warm-up command from the command/image processing section 102, the heater motor 116 drives the heat roller 61. The mechanism controller 104 then adjusts the fixing temperature by turning on and off the heater 63 in accordance with the output of the thermistor 64. The command/image processing section 102 starts a printing operation when the fixing temperature reaches a preset temperature high enough for fixing the toner image on the paper P.

The command/image processing section 102 controls the mechanism controller 104, which in turn controls the belt motor 113, drum motor 114, and secondary transfer motor 115, thereby driving the drive roller 33, various rollers of print engines 10K, 10Y, 10M, 10C, and 10W, and secondary transfer roller 35.

Concurrently with the control of the belt motor 113, drum motor 114, and secondary transfer motor 115, the mechanism controller 104 sends a command to the high voltage controller 120, which in turn drives the charging voltage generator 121, supply roller voltage generator 122, and developing roller voltage generator 123 to supply high bias voltages to the print engines 10K, 10Y, 10M, 10C, and 10W, respectively.

A description will be given of the operation of the print engines 10K, 10Y, 10M, 10C, and 10W. Each of the print engines 10K, 10Y, 10M, 10C, and 10W may be substantially identical; for simplicity, only the print engine 10K will be described, it being understood the remaining print engines 10Y, 10M, 10C, and 10W may work in a similar fashion.

The high voltage controller 120 supplies a charging voltage of −1100 V to the charging roller 12K, thereby charging the surface of the photoconductive drum 11K to −600 V. The high voltage controller 120 supplies voltages of −200 V and −250 V to the developing roller 16K and supply roller 18K, respectively, so that an electric field is developed in the vicinity of the nip area formed between the developing roller 16K and supply roller 18K. The black toner supplied from the toner cartridge 15K is triboelectrically charged due to the friction between the developing roller 16K and the supply roller 18K and the polarity of voltages applied to the developing roller 16K and the supply roller 18K. In the present embodiment, the toner is negatively charged. The negatively charged toner is deposited to the developing roller 16K by the Coulomb force due to the electric field in the direction from the developing roller 16K to the supply roller 18K. As the developing roller 16K rotates, the toner on the developing roller 16K is brought into contact with the developing blade 17K, which in turn forms a thin toner layer having a uniform thickness on the developing roller 16K. As the developing roller 16K further rotates, the thin toner layer is brought into contact with the electrostatic latent image formed on the photoconductive drum 11K.

In the mean time, the command/image processing section 102 sends the bit map data to the LED head interface 103 on a page-by-page basis. The LED head interface 103 drives the LEDs of the LED head 20K to be energized in accordance with the bit map data received from the command/image processing section 102, thereby forming an electrostatic latent image on the photoconductive drum 11K. The charges in illuminated areas have been dissipated so that the illuminated areas have a potential of about −50V.

As the photoconductive drum 11K rotates, the electrostatic latent image moves into contact with the thin toner layer formed on the developing roller 16K. Since the toner on the developing roller 16K has been negatively charged, the toner is attracted only to the areas illuminated by the LED head 20K. Thus, the electrostatic latent image is developed with the black toner.

Next, a description will be given of a primary transfer operation in which the toner images formed on the photoconductive drums 11K, 11Y, 11M, 11C and 11W are transferred onto the intermediate transfer belt 32, and a secondary transfer operation in which the toner image on the intermediate transfer belt 32 is transferred onto the paper P.

As the photoconductive drums 11K, 11Y, 11M, 11C, and 11W rotate, the toner images on the photoconductive drums 11K, 11Y, 11M, 11C, and 11W arrive at corresponding transfer points defined between the intermediate transfer belt 32 and the photoconductive drums 11K, 11Y, 11M, 11C, and 11W. The mechanism controller 104 then sends a command to the high voltage controller 120, commanding to generate the primary transfer voltages in timed relation with the arrival of the respective toner images at the transfer points. In response to the command, the high voltage controller 120 drives the primary transfer voltage generator 124 to supply the primary transfer voltages to the primary transfer rollers 31K, 31Y, 31M, 31C, and 31W. The primary transfer voltage according to the present embodiment is selected to be +3000 V. The primary transfer voltages applied to the transfer rollers 31K, 31Y, 31M, 31C, and 31W develop electric fields in the direction from the transfer rollers 31K, 31Y, 31M, 31C, and 31W to the corresponding photoconductive drums 11K, 11Y, 11M, 11C, and 11W, so that the negatively charged toner images of the corresponding colors are transferred one over the other onto the intermediate transfer belt 32 in sequence.

Before the toner image on the intermediate transfer belt 32 arrives at the secondary transfer nip formed between the secondary transfer roller 35 and the tension roller 36, the mechanism controller 104 causes the hopping motor 111 to drive the hopping roller 52 into rotation, thereby feeding a sheet of the paper P from the paper cassette 51 into the nip between the pinch roller 53 and registry roller 54. The mechanism controller 104 monitors the output of the paper sensor 56 to detect when the leading edge of the paper P arrives at the nip between the pinch roller 53 and the registry roller 54. Once the leading edge of the paper P is detected, the mechanism controller 104 stops the hopping motor 111.

The mechanism controller 104 causes the registry motor 112 to drive the pinch roller 53 and the registry roller 54 into rotation when the toner image on the intermediate transfer belt 32 arrives at the nip formed between the secondary transfer roller 35 and the tension roller 36. The guide 55 guides the paper P to the nip where the secondary transfer takes place.

The mechanism controller 104 sends a command to the high voltage controller 120, commanding to generate the secondary transfer voltage when the toner image on the intermediate transfer belt 32 arrives at the secondary transfer nip. In response to the command, the high voltage controller 120 drives the secondary transfer voltage generator 125 to supply the secondary transfer voltage to the secondary transfer roller 35. In the present embodiment, the secondary transfer voltage is selected to be +2500 V. Since the toner on the intermediate transfer belt 32 has been negatively charged, the toner image is attracted to the paper P due to the electric field developed across the secondary transfer roller 35 and the tension roller 36.

After passing through the secondary transfer roller 35, the paper P leaves the intermediate transfer belt 32, being guided by the guide 42 to the fixing mechanism 60. When the paper P is being guided, the mechanism controller 104 monitors the output of the sensor 41 to detect whether the paper P has wrapped around the secondary transfer roller 35 and whether the paper P has successfully left the intermediate transfer belt 32.

When the paper P arrives at the fixing mechanism 60, the paper P is pulled in between the heat roller 61 and the pressure roller 62 which have reached a predetermined temperature, so that the toner image on the paper P is fused by heat and pressure into the paper P.

After fixing, the paper P is guided by the guides 45, and is discharged by discharging rollers (not shown) onto the stacker 44. When the paper P is being guided, the mechanism controller 104 monitors the output of the sensor 43 to detect whether the paper P has become jammed or has wrapped around the heat roller 61.

Concurrently with the fixing operation, the cleaning blade 71 scrapes the residual toner from the intermediate transfer belt 32 into the waste toner tank 73.

After completion of all processes, the mechanism controller 104 causes the belt motor 113, drum motor 114, and secondary transfer motor 115 to stop, and sends a command to the high voltage controller 120, commanding the charging voltage generator 121, supplying roller voltage generator 122, and developing roller voltage generator 123 to stop supplying the high bias voltages to the rollers of the print engines 10K, 10Y, 10M, 10C, and 10W. The mechanism controller 104 causes the heater motor 116 and heater 63 to stop, thereby completing the printing operation.

{Toners According to Invention}

The toner according to the present invention will be described. A white solid toner image is formed as a background on the entire surface of the print paper P, and at least one of black, yellow, magenta, and cyan images is formed on the white toner image. The solid white toner image serves to cover the color of the paper P other than white.

If a color toner image other than a white toner image is mixed with the white toner image, a desired shade of color is not obtained.

Figure 3A:
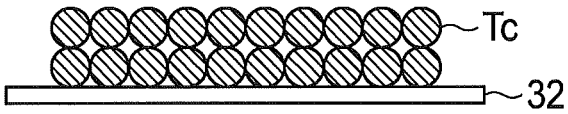
FIGS. 3A-3C illustrate how a white toner and a cyan toner are transferred when the white toner has a larger average particle diameter than the cyan toner.
Figure 3B:
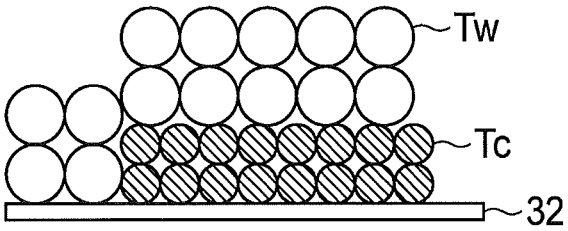
Figure 3C:
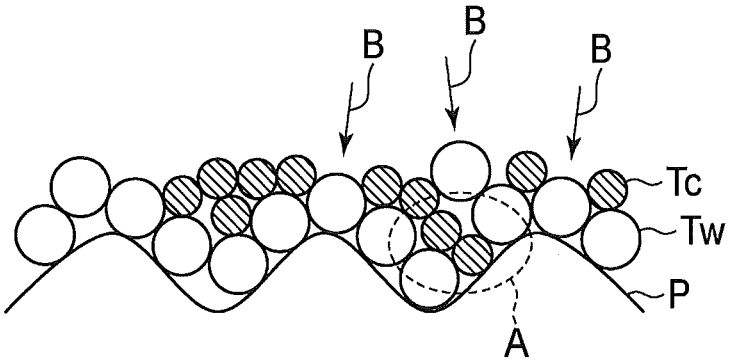

FIGS. 3A-3C illustrate how the white toner and the cyan toner are transferred when the white toner has a larger average particle diameter than the cyan toner.

With reference to FIGS. 3A-3C, a description will be given of a case in which the white toner has a larger particle diameter than the color toner, e.g., cyan, other than white toner.

Referring to FIG. 3A, the cyan toner Tc is transferred onto the relatively smooth surface of the intermediate transfer belt 32 having small surface relief heights (i.e., ridges and furrows). Subsequently, the white toner Tw is transferred onto the layer of the cyan toner Tc, as shown in FIG. 3B.

Referring to FIG. 3C, the cyan toner Tc and the white toner Tw formed on the intermediate transfer belt 32 are transferred onto the paper P. As a result, the white toner layer is first transferred onto the paper P and then the cyan toner layer is transferred onto the white toner layer, the white toner layer serving to cover the color of the paper P.

Due to manufacturing errors and fibers of the material, the paper P has relatively large surface relief heights. For example, the surface relief heights of the paper P are larger than those of the intermediate transfer belt 32. When the toner images are transferred from the intermediate transfer belt 32 onto the paper P, if the average particle diameter of the white toner Tw is not sufficiently small as compared to the surface relief heights of the paper P, the particles of the white toner Tw cannot sufficiently fill the furrows in the paper P, failing to provide a sufficiently smooth surface of the layer of the white toner Tw. Since the cyan toner Tc has a smaller average particle diameter than the white toner Tw, the particles of the cyan toner Tc tend to enter the gaps among the particles of the white toner Tw. The larger the average particle diameter of the white toner Tw, the larger the gaps among the white toner particles, so that more of the cyan toner particles enter an area A, enclosed in dotted line in FIG. 3C. As a result, some of the cyan toner particles get under the white toner particles, so that some of the particles of the cyan toner are mixed with those of the white toner Tw and are therefore difficult to be deposited on the ridges of the layer of the white toner Tw, causing the white toner particles to become exposed as shown by arrows B in FIG. 3C.

As described above, if the cyan toner Tc has a smaller average particle diameter than the white toner Tw, the cyan toner particles tend to enter the gaps among the white toner particles, so that the cyan toner particles are covered with the white toner particles. As a result, the cyan toner image has a lighter shade of color than it should have. The white toner having a large particle diameter fails to provide a white toner layer having a smooth surface, preventing the cyan toner Tc from being transferred uniformly onto the white toner layer. This causes the change in the shade of color.

For the aforementioned reasons, the white toner Tw has a smaller average particle diameter than the cyan toner Tc. The average particle diameter according to the present embodiment is a median diameter in a distribution of particle size expressed in terms of a projected area diameter and measured by microscopy.

Figure 4A:
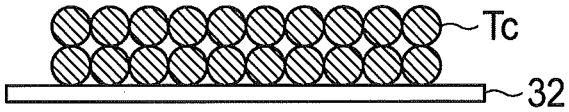
FIGS. 4A-4C illustrate how the white toner and the cyan toner are transferred when the white toner has a smaller average particle diameter than the cyan toner.
Figure 4B:
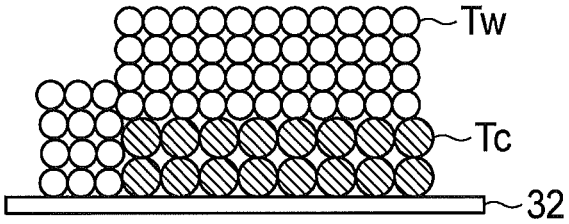
Figure 4C:
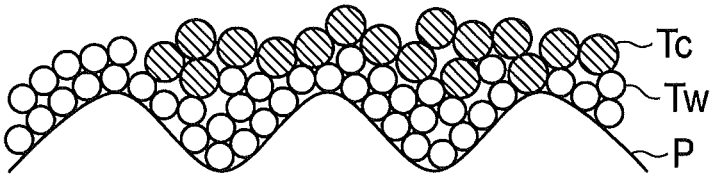

FIGS. 4A-4C illustrate how the toner particles are transferred when the white toner Tw has a smaller average particle diameter than the cyan toner Tc.

The image of the cyan toner Tc is transferred onto the intermediate transfer belt 32 as shown in FIG. 4A, and then a solid image of the white toner Tw is transferred onto the cyan toner Tc as shown in FIG. 4B. Subsequently, the solid image of the white toner Tw and the image of the cyan toner Tc are transferred onto the paper P as shown in FIG. 4C.

The white toner Tw having a smaller average particle diameter than the cyan toner Tc reduces the chance of the particles of the cyan toner Tc entering the gaps among the particles of the white toner Tw when the toners Tw and Tc are transferred onto the paper P, which reduces the chance of the particles of the cyan toner Tc being mixed with the particles of the white toner Tw. The white toner Tw with a relatively small average particle diameter is advantageous in filling the furrows in the surface of the paper P, providing a relatively smooth surface of the layer of the white toner Tw and hence relatively uniform transfer of the cyan toner particles.

FIG. 5 is a table that lists the experimental results, illustrating the relationship between the average particle diameter of the white toner Tw and the change in shade of color due to the mixture of the white toner Tw and cyan toner Tc.

In this experiment, using a cyan toner having an average particle diameter of 7.0 μm and white toners having average particle diameters of 6.0, 6.1, 6.3, 6.5, 6.7, 6.9, 8.9, and 11.2 μm, the shades of color caused by the mixture of the white toner and cyan toner were measured. The shades of color are expressed in terms of a color difference ΔE. The color differences ΔE were measured for white toners having these eight different average particle diameters. A rectangular solid cyan image of 30×25 mm was printed directly on white paper that serves as a reference, and then the Lab value of the solid cyan image, a first Lab value, was measured using a spectrophotometer, MODEL CM-2600d available from KONIA MINOLTA. Rectangular solid white images of 30×25 mm were printed on the white paper and then the solid cyan image was printed on each of the white solid images in registration, and then the Lab values of the solid cyan images, second Lab values, were measured. The first Lab value is compared with the second Lab values. The smaller the ΔE, the smaller the change in the shade of color. In other words, a small ΔE indicates that only small portions of the white toner and cyan toner are mixed. The color differences ΔE were measured for eight different white toners, and were then evaluated. Specifically, the color differences ΔE were rated on a scale of five levels: $\Delta E>10$, $5\leq\Delta E\leq10$, $3<\Delta E\leq5$, $1<\Delta E\leq3$, and $\Delta E\leq3$. The color differences in the range of $\Delta E>10$ indicate "very poor." The color differences in the range of $5\leq\Delta E\leq10$ indicate "poor." The color differences in the range of $3\leq\Delta E\leq5$ indicate "slightly poor." The color differences in the range of $1\leq\Delta E\leq3$ indicate "good." The color differences in the range of $\Delta E\leq1$ indicate "very good." Referring to FIG. 5, symbol "XX" denotes "very poor" and symbol "X" denotes "poor." Symbol "Δ" denotes "slightly poor" and symbol "○" denotes "good." The symbol "◎" denotes "very good." The symbols "○" and "◎" are color differences which users are unable to detect. The symbol "XX" and "X" are color differences which are unsatisfactory to the users by inspection. The "Δ" is a color difference which is difficult to detect by inspection but is still not acceptable.

The experimental results listed in FIG. 5 show that white toners having smaller average particle diameters cause smaller changes in the shade of color if the cyan toner has a fixed average particle diameter of 7.0 μm. The white toner having an average particle diameter of 6.5 μm or less resulted in "good" or better color differences. The ratio of the average particle diameter of 6.5 μm of the white toner to that of 7 μm of the cyan toner is $6.5/7.0=0.93\approx0.95$.

The color toner according to the present invention has an average particle diameter of 6.9 μm, more specifically, in the range of 6.8 to 7.0 μm due to the manufacturing errors.

In the first embodiment, the cyan toner has a minimum average particle diameter of 6.8 μm. FIG. 6 lists experimental changes in the shade of color when the cyan toner having an average particle diameter of 6.8 μm is mixed with the white toner having eight different average particle diameters. The experiments were conducted under the same condition except the average particle diameter of 6.8 μm of the cyan toner. As is clear from FIG. 6, the change in the shade of color (ΔE) was "good" for the white toner having an average particle diameter of 6.3 μm or smaller. The ratio of the average particle diameter of 6.3 μm of the white toner to that of 6.8 μm of the cyan toner is $6.3/6.8=0.93\approx0.95$.

Similar experiments were conducted for black, yellow, and magenta toners, and the results were quite similar to those described above.

The above described experimental results show that the ratio of the average particle diameter of the white toner to that of the color toner not larger than 0.95 is effective in reducing the unwanted mixture of the white toner and color toner, thus implementing a desired shade of color. If a color toner has an average particle diameter of 6.9+0.1 μm, the white toner may have an average particle diameter equal to or smaller than 6.7 μm, preferably equal to or smaller than 6.5 μm, so that the unwanted mixture of the white toner and the color toner may be reduced, implementing a desired shade of color. If a color toner has an average particle diameter of 6.9-0.1 μm, the white toner may have an average particle diameter equal to 6.5 μm or smaller, preferably 6.3 μm or smaller, thereby implementing a desired shade of color. Manufacturing the toner having an average particle diameter smaller than 6.0 μm is difficult or at least not economical. Thus, the average particle diameter of the white toner is preferably equal to or larger than 6.0 μm.

In order to fill the furrows in the paper P, the white toner preferably has an average particle diameter smaller than the furrows. The ridges and furrows in the paper P are expressed in terms of ten-point height of irregularities Rz defined by JIS B0601:1944. The thickness of the white toner image is preferably larger than that of the color toner image, and is preferably larger than the ridges and furrows in the paper P.

{Effects}

The first embodiment provides the following advantages. The first toner image (e.g., white toner image) and the second toner image (e.g., color image) are transferred onto the paper P in this order. The first toner has a smaller average particle diameter than the second toner. Therefore, when the first and second toners are transferred onto the recording medium in this order, there is less chance of the second toner entering the gaps among the first toner particles, which provides a good image quality.

The first toner (e.g., white toner) is used to form a background and the second toner (e.g., color toner) is used to form an image on the first toner. The use of the white toner (first toner) having an average particle diameter not larger than that of the color toner (second toner) reduces the change in the shade of color that would otherwise be caused.

In one embodiment, the average particle diameter of the first toner (e.g., white toner) is equal to or smaller than 0.95 times that of the second toner (e.g., color toner). This ratio of the diameters is effective in reducing unwanted mixture of the first and second toners.

In one embodiment, the first toner has an average particle diameter not smaller than 6.0 μm and not larger than 6.7 μm, preferably not larger than 6.5 μm. When the second toner has an average particle diameter not smaller than 7.0 μm, the unwanted mixture of the first and second toners may be minimized.

In one embodiment, the first toner has an average particle diameter not smaller than 6.0 μm and not larger than 6.5 μm, preferably not larger than 6.3 μm. When the second toner has an average particle diameter not smaller than 6.8 μm, the unwanted mixture of the first and second toners may be minimized.

In one embodiment, the toner image formed of the first toner (e.g., white toner) has a larger thickness than that formed of the second toner (e.g., color toner). Therefore, the first toner serves to smooth out the surface relief heights of the recording medium (e.g., paper P), and then the second toner is transferred onto the surface of the layer of the first toner which has been a relatively smooth surface.

In one embodiment, the first toner (e.g., white toner) has an average particle diameter smaller than the furrows in the surface of the recording medium, which advantageously fills the furrows to create a smoothed, flat surface which allows the second toner to be transferred uniformly onto the layer of the first toner.

In one embodiment, the image forming apparatus includes an image bearing body (e.g., intermediate transfer belt), a first image forming section (e.g., print engines 10K, 10Y, 10M, 10C, and 10W) that forms a first toner image (e.g., cyan toner image) on the image bearing body, a second image forming section (e.g., print engine 10W) that forms a second toner image (white toner image) in registration with the first toner image, and a transfer section (e.g., secondary transfer roller). The surface of the image bearing body has furrows larger than the average particle diameter of the second toner (e.g., white toner). The flatness (ridges and furrows) of the surface of the image bearing body is expressed in terms of ten point height of irregularities Rz determined by JIS B061:1994. This embodiment minimizes the mixture of the first and second toners on the image bearing body, and provides good images.

The surface of the image bearing body (specifically an intermediate transfer belt) may have furrows smaller than the average particle diameter of the first toner (e.g., white toner).

Second Embodiment

An image forming apparatus according to a second embodiment will be described. The image forming apparatus according to the second embodiment differs from that according to the first embodiment in the toner used in the print engine 10W. The second embodiment will be described with respect to portions different from those of the first embodiment. Like elements have been given like reference numerals and a detailed description thereof is omitted.

Figure 7A:
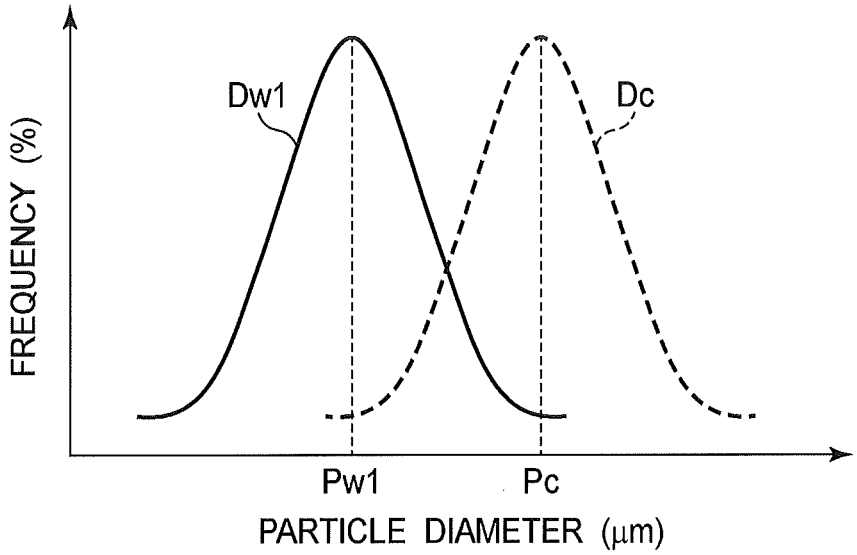
FIGS. 7A and 7B illustrate the distribution of the toner particle diameters.
Figure 7B:
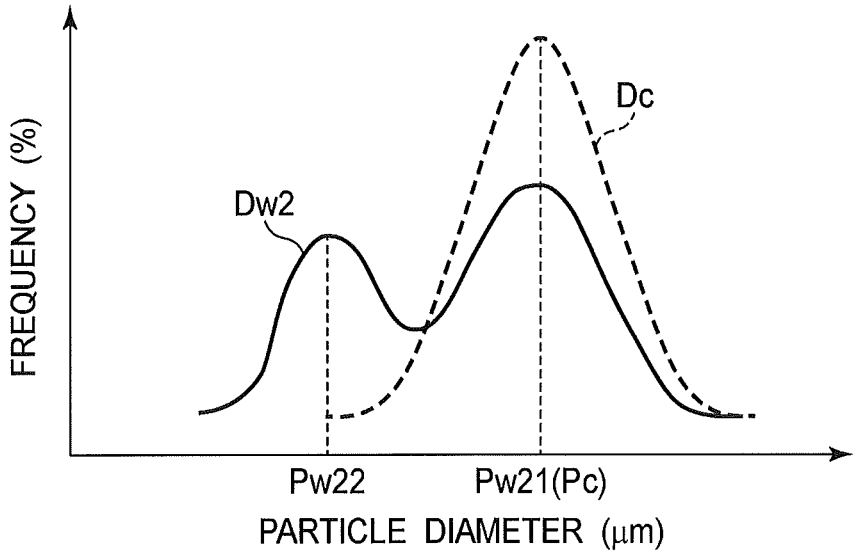

FIGS. 7A and 7B illustrate the distribution of the toner particle diameters. A description will be given of the white toner used in the second embodiment.

FIG. 7A shows a distribution Dw1 of the particle diameters for the white toner and a distribution Dc of the particle diameters for a color toner, according to the first embodiment. The distribution Dw has a peak at a particle diameter Pw1 and the distribution Dc has a peak at a particle diameter Pc, the Pw1 being smaller than the Pc. For example, Pw1 is 6.5 μm and Pc is 6.9 μm. The profile of the distributions Dw1 and Dc is substantially identical. In order for the white toner to have a smaller average particle diameter than the color toner, the distribution Dw1 is selected so that the Pw1 is much smaller than the Pc. Thus, most of the white toner particles have smaller particle diameters than the color toner particles.

FIG. 7B shows the distribution Dw2 of particle diameters for the white toner according to the second embodiment and a distribution Dc of particles diameter for the color toner, according to the second embodiment. In the second embodiment, the profile of the distribution Dw2 of the white toner has a first peak Pw21 and a second peak Pw22, the first peak Pw21 having substantially the same average particle diameter as the average particle diameter of the color toner and the second peak Pw22 having a smaller particle diameter than the first peak Pw21. In other words, a large, significant proportion of the white toner is distributed in the vicinity of the second peak Pw22 smaller than the first peak Pw21 so that the average particle diameter of the white toner is smaller than that of the color toner. For example, Pw21=Pc=6.9 μm and 6.0 μm<Pw22<6.5 μm. The white toner according to the second embodiment may be obtained by mixing a white toner having substantially the same distribution of particle diameters as the color toner with a fine white toner having an average diameter in the vicinity of the smallest diameters of the color toner, as shown in FIG. 7B.

From a point of view of filling the furrows in the paper P as a recording medium, the particle diameter of the second peak Pw22 is preferably smaller than the furrows in the paper P. For example, the white toner preferably includes fine toner particles having smaller diameters than the paper P. The furrows in the paper P are expressed in terms of ten point height irregularities Rz determined under JIS B0601:1944. The height irregularity Rz of ordinary paper is in the range of 14 to 20 μm.

Figure 8A:
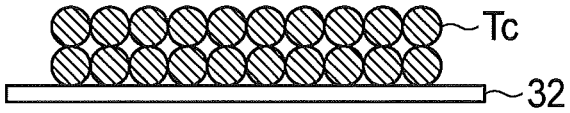
FIGS. 8A-8D illustrate how toners are transferred onto a transfer belt and paper.
Figure 8B:
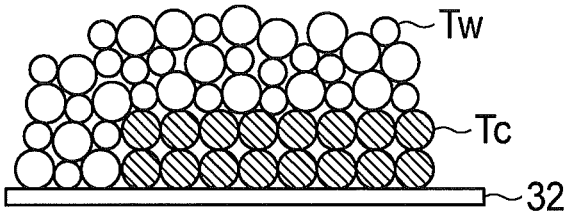
Figure 8C:
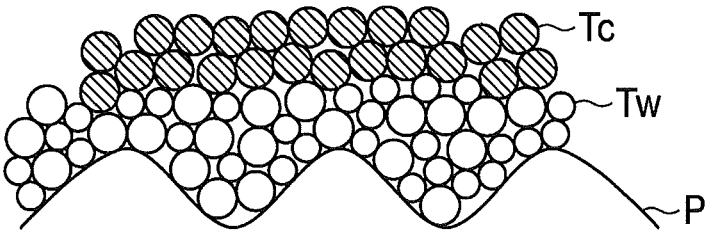
Figure 8D:
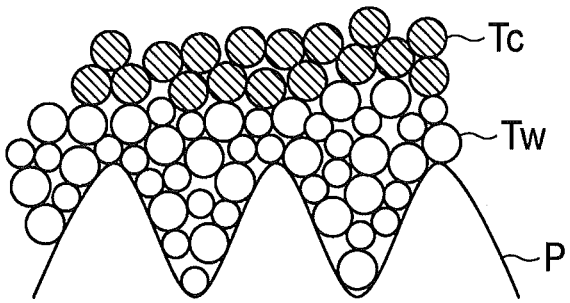

FIGS. 8A-8D illustrate how toners are transferred onto an intermediate transfer belt 32. Referring to FIGS. 8A and 8B, a cyan toner Tc is first transferred onto the intermediate transfer belt 32 and then a white toner Tw is transferred onto the cyan toner Tc in registration. The cyan toner Tc and the white toner Tw are then transferred onto paper P as shown in FIGS. 8C and 8D. The paper P has surface relief which is in a variety of shapes depending on the material and manufacturing method thereof, some paper having relatively large surface relief heights (i.e., ridges and furrows) and some other paper having relatively small surface relief heights. FIG. 8C illustrates how the toner is transferred onto the paper P having relatively small furrows. FIG. 8D illustrates how the toner is transferred onto the paper P having relatively large surface relief heights.

Referring to FIGS. 8C and 8D, the white toner having a large proportion of fine, smaller diameter particles effectively fills a variety of furrows of different sizes in the surface of the paper P, so that the cyan toner may be uniformly transferred onto a layer of the white toner.

The second embodiment provides the following effects in addition to those obtained by the first embodiment.

The profile of a distribution of first toner (e.g., white toner) has a first peak and a second peak. The first peak is located at substantially the same particle diameter as the peak of a second toner (e.g., color toner), the second peak being located at a smaller particle diameter than the first peak. This profile of distribution decreases the chance of the first toner (white toner) being mixed with the second toner (e.g., color toner) when the toners are transferred onto the paper having surface relief heights, thereby providing a good image quality.

In one embodiment, the peak of the profile of distribution is located at a particle diameter smaller than the furrows in the recording medium. The second embodiment enables the furrows in a variety of recording media to be filled. For example, fine toner particles smaller than the furrows in the recording medium may be advantageously used for a recording medium having smaller furrows.

The smaller the particle diameter of toner, the higher the manufacturing cost. Thus, the profile of distribution of toner particles shown in FIG. 7B may be more advantageous in terms of manufacturing cost than that shown in FIG. 7A.

The smaller the toner particle diameter is, the larger the amount of charge, i.e., the absolute value of Q/M (Q: charge, M: weight of toner particles) on the toner particles is. Thus, a larger amount of charge on the toner requires a higher transfer voltage during a transfer process. For this reason, the profile of the distribution of particle diameters shown in FIG. 7B is more advantageous than that shown in FIG. 7A.

While the first and second embodiments have been described with respect to the combination of the white toner and color toner, the combination is not limited to this. A variety of combinations may be possible as long as use of two toners may cause unwanted mixing of the toners that deteriorates image quality. For example, the invention may be applied to a case in which a first toner forms a first toner image and a second toner covers the first toner image. The first toner may be a color toner and the second toner may be a transparent toner, in which case, the first toner may have a smaller average particle diameter than the second toner so that unwanted mixing of the first and second toners may be minimized or prevented. For example, the transparent toner may be used to provide the image with a gloss finish.

Figure 9:
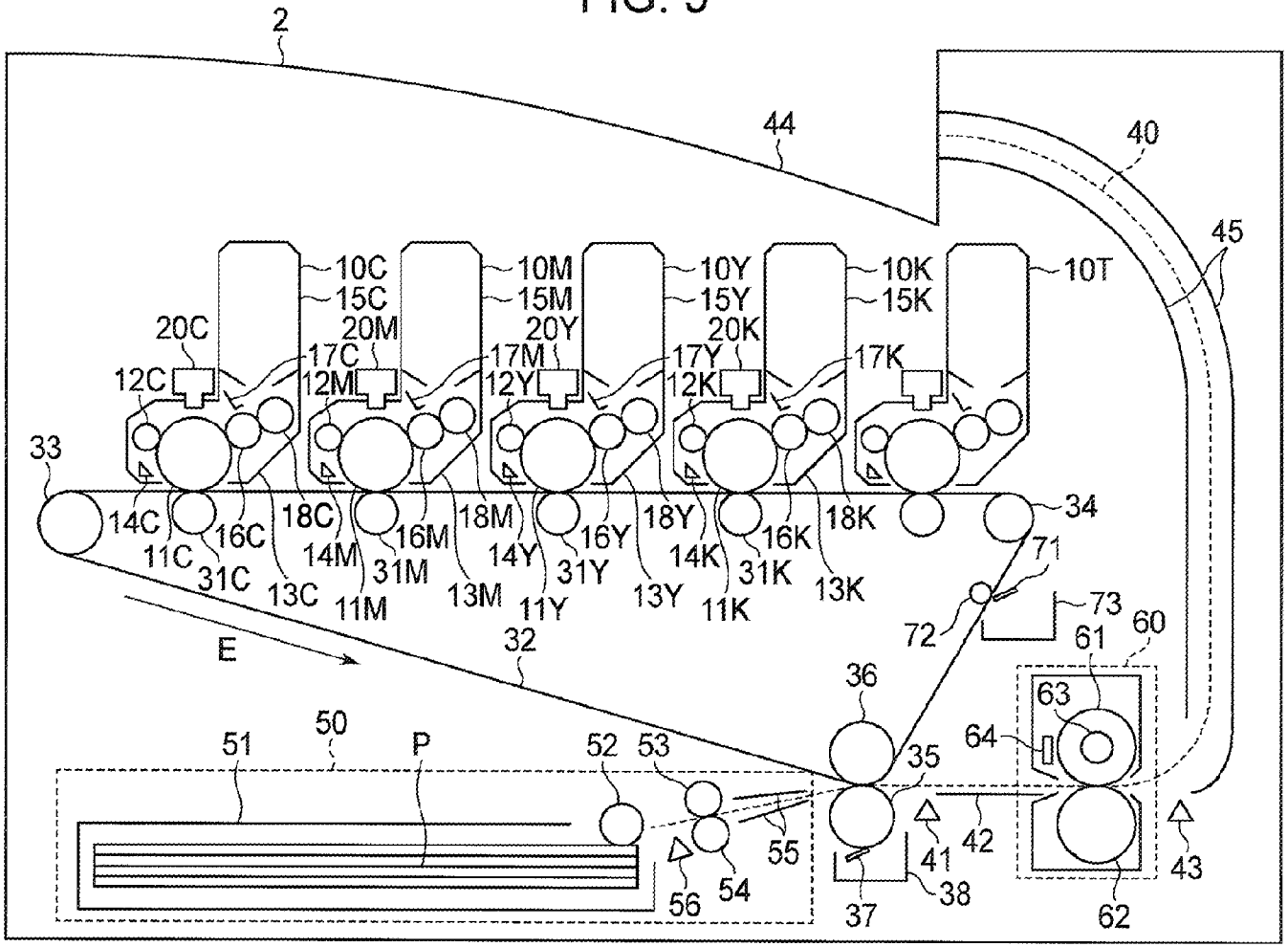
FIG. 9 illustrates the outline of the configuration of an image forming apparatus that employs a transparent toner.

FIG. 9 illustrates the outline of the configuration of an image forming apparatus 2 that employs a transparent toner Tt. The image forming apparatus 2 has substantially the same configuration as the image forming apparatus 1, but includes print engines 10T, 10K, 10Y, 10M, and 10C that form a transparent image, a black image, a yellow image, a magenta image, and a cyan image, respectively. The print engine 10T is disposed upstream of the print engines 10K, 10Y, 10M, and 10C with respect to the direction of travel of the intermediate transfer belt 32.

The first and second embodiments have been described in terms of an intermediate transfer image forming apparatus, but are not limited to this. Instead, the present invention may be applied to a direct transfer image forming apparatus.

Figure 10:
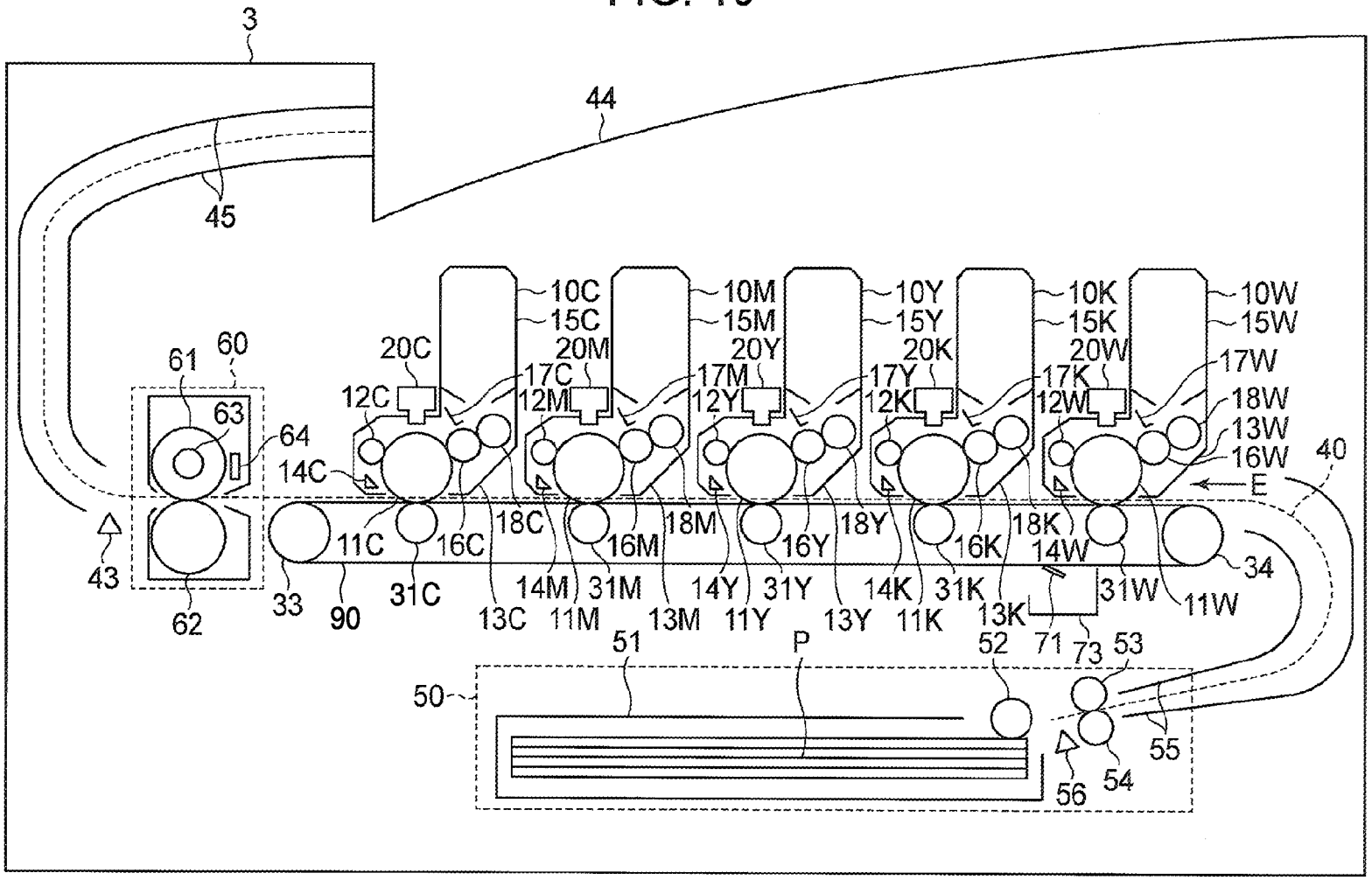
FIG. 10 illustrates the outline of a direct transfer image forming apparatus.

A direct transfer image forming apparatus includes at least two print engines: a first print engine has a first image forming section that forms a first toner image (e.g., white toner image) on a first image bearing body (e.g., photoconductive drum) and a second print engine has a second image forming section that forms a second toner image (e.g., color toner image) on a second image bearing body (e.g., photoconductive drum). Each print engine includes a charging unit that charges the surface of the image bearing body, an exposing unit that illuminates the charged surface of the image bearing body to form an electrostatic latent image, a developing unit that supplies the toner to the electrostatic latent image to develop the electrostatic latent image with the toner into a toner image, and a transfer unit that transfers the toner image directly onto a recording medium. FIG. 10 illustrates the outline of a direct transfer image forming apparatus 3. Elements similar to those shown in FIG. 1 have been given similar reference numerals and a description thereof is omitted. The photoconductive drums 11W, 11K, 11Y, 11M, and 11C are aligned along a transport belt 90 in a direction of travel of the paper P, and form toner images of the respective colors. As opposed to an intermediate transfer image forming apparatus, the toner images formed by the print engines 10K, 10Y, 10M, 10C, and 10W are not transferred onto the transport belt 90 but directly onto the paper P. Since the white toner image formed in the print engine 10W is transferred onto the paper P before the toner images of the respective colors, i.e., black, yellow, magenta, and cyan, are transferred onto the paper P, the print engine 10W is located upstream of the print engines 10K, 10Y, 10M, and 10C. When the transport belt 90 advances through the print engines 10W, 10K, 10Y, 10M, and 10C, the transport belt 90 receives the paper P from the paper feeding mechanism 50, and transports the paper P in a direction shown by arrow E. The transfer rollers 31W, 31K, 31Y, 31M and 31C transfer the toner images, formed on the photoconductive drums 11W, 11K, 11Y, 11M, and 11C, onto the paper P. The paper P is then fed to a fixing mechanism 60 where the toner images on the paper P are fixed by heat and pressure. After fixing, the paper P is discharged through guides 45 onto a stacker 44.

The first and second embodiments have been described in terms of a configuration in which four color toners, i.e., black (K), yellow (Y), magenta (M), and cyan (C), are used. The number of colors is not limited to four. The image forming apparatus may be a color printer that uses a single color (e.g., black).

The invention is not limited to the first and second embodiments and may be modified in a variety of ways within the scope of the invention.

What is claimed is:

1. An image forming apparatus, comprising:

a first print engine that forms a first image formed of a first toner having a first average particle diameter; and a second print engine that forms a second image formed of a second toner having a second average particle diameter larger than the first average particle diameter, wherein the first image and the second image are transferred onto a recording medium in that stated order, and wherein the first toner is a white toner and the second toner is a color toner other than white.

2. The image forming apparatus according to claim 1, wherein the first image is a solid image formed on an entire surface of the recording medium.

3. The image forming apparatus according to claim 1, wherein the first average particle diameter is not larger than 0.95 times the second average particle diameter.

4. The image forming apparatus according to claim 1, wherein the first average particle diameter is not smaller than 6.0 μm and not larger than 6.5 μm.

5. The image forming apparatus according to claim 1, wherein the first image has a larger thickness than the second image.

6. The image forming apparatus according to claim 1, wherein the first average particle diameter is smaller than surface relief heights of the recording medium.

7. The image forming apparatus according to claim 1, further comprising:

an image bearing body; and a secondary transfer section;

wherein the second print engine transfers the second image onto the image bearing body, and then the first print engine transfers the first image onto the second image;

wherein the secondary transfer section transfers the first image and the second image formed on the image bearing body onto the recording medium;

wherein the image bearing body has surface relief heights smaller than the first average particle diameter.

8. The image forming apparatus according to claim 7, wherein the recording medium has larger surface relief heights than the image bearing body.

9. The image forming apparatus according to claim 1, wherein the first image has a thickness larger than surface relief heights of the recording medium.

10. An image forming apparatus, comprising:

a first print engine that forms a first image formed of a first toner having a first average particle diameter; and a second print engine that forms a second image formed of a second toner having a second average particle diameter larger than the first average particle diameter, wherein the first image and the second image are transferred onto a recording medium in that stated order, and wherein the first toner is a color toner and the second toner is a transparent toner.

11. The image forming apparatus according to claim 10, wherein the second image is a solid image that covers an entire area of the first image.

12. The image forming apparatus according to claim 10, further comprising:

an image bearing body; and a secondary transfer section;

wherein the second print engine transfers the second image onto the image bearing body, and then the first print engine transfers the first image onto the second image;

wherein the secondary transfer section transfers the first image and the second image onto the recording medium;

wherein the image bearing body has surface relief heights larger than the average particle diameter of the second toner.

13. An image forming apparatus, comprising:

a first print engine that forms a first image formed of a first toner having a first average particle diameter; and a second print engine that forms a second image formed of a second toner having a second average particle diameter larger than the first average particle diameter, wherein the first image and the second image are transferred onto a recording medium in that stated order, and wherein the first toner has a profile of distribution of particle diameters that includes a first peak of profile and a second peak of profile, the first peak of profile being at a first particle diameter and the second peak of profile being at a second particle diameter smaller than the first particle diameter.

14. The image forming apparatus according to claim 13, wherein the second peak of profile is at a particle diameter smaller than surface relief heights of the recording medium.

15. The image forming apparatus according to claim 13, wherein the first toner is a white toner and the second toner is a color toner other than white.

16. The image forming apparatus according to claim 13, wherein the first toner is a color toner and the second toner is a transparent toner.

17. The image forming apparatus according to claim 13, wherein the first average particle diameter is not larger than 0.95 times the second average particle diameter.

18. The image forming apparatus according to claim 13, wherein the first average particle diameter is not smaller than 6.0 μm and not larger than 6.5 μm.

19. The image forming apparatus according to claim 13, wherein the first image has a larger thickness than the second image.

20. The image forming apparatus according to claim 13, wherein the first average particle diameter is smaller than surface relief heights of the recording medium.

21. The image forming apparatus according to claim 13, further comprising:

an image bearing body; and a secondary transfer section;

wherein the second print engine transfers the second image onto the image bearing body, and then the first print engine transfers the first image onto the second image;

wherein the secondary transfer section transfers the first image and the second image formed on the image bearing body onto the recording medium;

wherein the image bearing body has surface relief heights smaller than the first average particle diameter.

22. The image forming apparatus according to claim 21, wherein the recording medium has larger surface relief heights than the image bearing body.

23. The image forming apparatus according to claim 21, wherein the first image has a thickness larger than surface relief heights of the recording medium.

* * * * *